US008617272B2

(12) United States Patent
Yamahara

(10) Patent No.: US 8,617,272 B2
(45) Date of Patent: Dec. 31, 2013

(54) ABRASIVE MATERIAL PRODUCT CONTAINING INCLUSION COMPOUND

(75) Inventor: Michihiro Yamahara, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 286 days.

(21) Appl. No.: 13/059,312

(22) PCT Filed: Aug. 31, 2009

(86) PCT No.: PCT/US2009/055506

§ 371 (c)(1),
(2), (4) Date: Feb. 16, 2011

(87) PCT Pub. No.: WO2010/027937

PCT Pub. Date: Mar. 11, 2010

(65) Prior Publication Data

US 2011/0143974 A1 Jun. 16, 2011

(30) Foreign Application Priority Data

Sep. 2, 2008 (JP) ..... 2008-224387

(51) Int. Cl.
*C09K 3/14* (2006.01)
*B24D 3/28* (2006.01)

(52) U.S. Cl.
USPC ..... 51/298; 51/295; 508/100

(58) Field of Classification Search
USPC ..... 508/100; 51/295, 298
See application file for complete search history.

(56) References Cited

U.S. PATENT DOCUMENTS

| | | | | |
|---|---|---|---|---|
| 3,314,884 | A * | 4/1967 | Cover | 508/154 |
| 4,609,380 | A | 9/1986 | Barnett | |
| 4,933,373 | A | 6/1990 | Moren | |
| 5,306,319 | A | 4/1994 | Krishnan | |
| 5,667,842 | A * | 9/1997 | Larson et al. | 427/258 |
| 5,725,617 | A | 3/1998 | Hagiwara | |
| 5,830,577 | A * | 11/1998 | Murayama et al. | 428/411.1 |
| 5,908,477 | A * | 6/1999 | Harmer et al. | 51/305 |
| 6,086,648 | A | 7/2000 | Rossetti | |
| 6,575,823 | B1 | 6/2003 | Obeng | |
| 2002/0026752 | A1 | 3/2002 | Culler | |

FOREIGN PATENT DOCUMENTS

| | | |
|---|---|---|
| JP | 63-251169 | 10/1988 |
| JP | 2000-034416 | 2/2000 |
| JP | 2006-130607 | 5/2006 |
| JP | 2007-290061 | 11/2007 |

OTHER PUBLICATIONS

In the book (Shokuhin kaihatsusha notameno shikurodekisutorin nyumon, Terao keiji, Sep. 23, 2004, K.K. nihon shuppan seisaku senta), α- cyclodextrin is used as a complexing aid for squalene (Reference on p. 134), for saturated fatty acid (Reference p. on 136, 153).

* cited by examiner

*Primary Examiner* — Jim Goloboy
(74) *Attorney, Agent, or Firm* — Scott A. Baum

(57) ABSTRACT

To provide an abrasive material product which shows an excellent effect of controlling heat generation in abrasive work and which causes no smearing in abrasive work in dry mode. An abrasive material product comprising a binder and an inclusion compound composed of a host compound and a lubricant contained therein as a guest compound.

14 Claims, 3 Drawing Sheets

ABRASIVE MATERIAL PRODUCT CONTAINING INCLUSION COMPOUND

CROSS REFERENCE TO RELATED APPLICATIONS

This application is a national stage filing under 35 U.S.C. 371 of PCT/US2009/055506, filed Aug. 31, 2009, which claims priority to Japanese Application No. 2008-224387, filed Sep. 2, 2008, the disclosures of which are incorporated by reference in their entirety herein.

This disclosure relates to abrasive material products, and particularly to abrasive material products for abrading or rubbing materials such as metal, plastics and wood.

BACKGROUND ART

Described in Patent literature 1 is a grinding wheel in which abrasive particles are fixed in a dispersed state throughout an organic matrix in which a new binder system has been mixed. In this grinding wheel, a commonly used lubricant may be added to the binder system. Examples of the commonly used lubricant include solid lubricants such as metal salts of stearic acid. Described in Patent literature 2 is an abrasive article comprising abrasive particles dispersed throughout and adhered within a stain-resistant, elastomeric, crosslinked polyurethane binder matrix. A lubricant and the like may be added to the abrasive article. Examples of the lubricant include butyl stearate.

Described in Patent literature 3 is an abrasive pad in which 5 to 60% by volume of a water-soluble substance is dispersed in a water-insoluble thermoplastic polymer having a Shore D hardness of 35 or more, wherein the water-soluble substance has an average particle diameter of 0.1 to 500 μm. When the particulate water-soluble substance exposed on the surface of the abrasive pad elutes into water of slurry or the like, fine pores are formed on the surface and some of the water-soluble substance remains therein to serve as filler. Examples of the water-soluble substance include cyclodextrin.

Described in Patent literature 4 is a bulky non-woven fabric abrasive material product comprising a) a substrate having a plurality of organic polymeric fibers, b) a plurality of abrasive grains, and c) a plurality of capsules each of which contains a lubricant as a core material and the shell of which is made of a thermocurable resin, wherein the abrasive grains and the capsules are adhered with a binder to the fibers and the binder adheres the fibers together at sites where a fiber is in contact with another fiber. The capsules are softened by frictional heat generated during the use of the non-woven fabric abrasive material product to release the lubricant, and thus exhibit stable lubricity without externally supplying a lubricant during work.

Described in Patent literatures 5 and 6 are non-woven fabric abrasive material products having: a non-woven fabric made of fibers arranged at random; a heat-resistant resin layer coated onto surfaces of fibers of the non-woven fabric; an adhesive agent adhered onto a surface of the heat-resistant resin layer; and abrasive particles adhered to the non-woven fabric with the adhesive agent. These non-woven fabric abrasive material products contain a reactive inorganic endothermic compound for controlling generation of heat in abrasive work.

[Patent literature 1] Japanese Patent Laid-open Publication No. S61-192479

[Patent literature 2] Japanese Patent Laid-open Publication No. H2-294336

[Patent literature 3] Japanese Patent Laid-open Publication No. 2000-34416

[Patent literature 4] Japanese Patent Laid-open Publication No. H8-108373

[Patent literature 5] Japanese Patent Laid-open Publication No. 2006-130607

[Patent literature 6] Japanese Patent Laid-open Publication No. 2007-290061

DISCLOSURE OF THE INVENTION

Problem to be Solved by the Invention

One objective of this disclosure is to provide an abrasive material product which shows excellent effect of controlling heat generation in abrasive work and which causes no smearing in abrasive work under dry mode. Another objective is to provide an abrasive material product which generates a suitable fragrance during work or removes an offensive smell.

Smearing refers to generation of stains due to degradation of an organic substance constituting an abrasive material product in abrasive work and subsequent adhesion of the degraded substance to a surface to be abraded. In particular, in fine surface finishing or mirror surface finishing, a large amount of heat generates, so that smearing is prone to occur.

When a smear is formed, that portion is covered to cause insufficient friction, so that the surface will be finished unevenly. Removal of a smear from the surface to be abraded requires new steps and therefore renders abrasive work complicated.

A lubricant has been generally employed as the means for preventing heat generation as conducting abrasion. The lubricant on the one hand reduces generation of frictional heat, on the other hand works as a medium for taking the heat from a part to be abraded.

In abrasive work in which a smear is generated due to frictional heat, an organic substance is burned easily to generate an offensive smell. Such an offensive smell has bad influence on working environment and will serve as one of causes of decrease in working efficiency. One means for easing the bad influence by an offensive smell may be to use a deodorant or an aromatic.

However, lubricants, deodorant and aromatics are usually liquid and therefore it is difficult to incorporate them into abrasive material products. For example, if a liquid lubricant or the like is dispersed and mixed in a binding resin, a binder is plasticated, thereby being weakened. Therefore, the power of holding abrasive particles is weakened, so that the abrasive power and durability as an abrasive material will decrease.

The abrasive material product of this disclosure widely includes materials to be used in applications of rubbing surfaces widely used in applications of cleaning and smoothly finishing surfaces of articles. It includes wiping materials made of a substrate, a binder, or the like and abrasive materials further containing abrasive particles.

MEANS FOR SOLVING THE PROBLEM

Figure 1A:
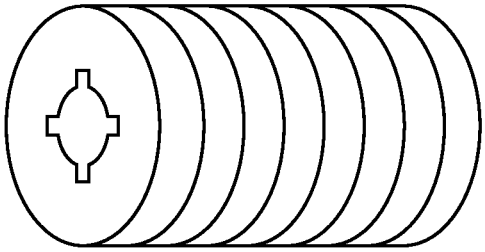
FIG. 1 Perspective view showing typical structure types of cylindrical abrasive brushes each having a center hole.

The present disclosure provides an abrasive material product comprising a binder and an inclusion compound composed of a host compound and a lubricant contained therein as a guest compound.

A certain embodiment is directed to the abrasive material product further comprising an inclusion compound composed of a host compound and an aromatic or a deodorant contained therein as a guest compound.

A certain embodiment is directed to any one of the preceding abrasive material products wherein the host compound is cyclodextrin.

A certain embodiment is directed to any one of the preceding abrasive material products wherein the binder comprises a resin component and content of the inclusion compound relative to 100 parts by mass of the resin component is from 0.5 to 200 parts by mass.

A certain embodiment is directed to any one of the preceding abrasive material products wherein molar ratio of molecules of the guest compound to molecules of the host compound is from 0.1 to 3.0.

A certain embodiment is directed to any one of the preceding abrasive material products wherein the binder comprises a water-based resin.

A certain embodiment is directed to any one of the preceding abrasive material products wherein the binder comprises a solvent-based resin.

A certain embodiment is directed to any one of the preceding abrasive material products wherein the abrasive material product is a non-woven fabric abrasive material product comprising a non-woven fabric and a binder adhered to fibers of the non-woven fabric.

A certain embodiment is directed to any one of the preceding abrasive material products further comprising a reactive inorganic endothermic compound.

A certain embodiment is directed to any one of the preceding abrasive material products further comprising abrasive particles.

A certain embodiment is directed to a method for producing an abrasive material product comprising:

a step of adding and uniformly dispersing an inclusion compound composed of a host compound and a lubricant contained therein as a guest compound to a binder to obtain a liquid to be applied, a step of applying the resulting liquid to be applied to a non-woven fabric, and a step of curing the binder.

EFFECT OF THE INVENTION

The abrasive material product of this disclosure can obtain various action and effects due to the kind of the guest compound. For example, when the guest compound is a lubricant, it shows an excellent effect of controlling heat generation in abrasive work. Therefore, no smear is generated even when fine surface finishing or mirror finishing is conducted in dry mode. It can be suitably used for abrasion of resin which has been heretofore difficult to be abraded, especially, thermoplastic resins and plastic materials because they do not thermally degrade objects to be abraded. Moreover, when the guest compound is an aromatic and a deodorant, it can generate a fragrance suitable for work for a long time or can remove an offensive smell over a long time.

BEST EMBODIMENT FOR CARRYING OUT THE INVENTION

The inclusion compound as used herein is a compound which exists as a stable substance wherein the guest compound is supported without a covalent bond within a space defined by a crystal lattice of the host compound. In the inclusion compound, the guest compound is divided into each molecule while being surrounded by the host compound. Therefore, if a host compound is miscible with a dispersion medium, a guest compound can exist in the dispersion medium so that its molecules will keep away from each other even if the guest compound is immiscible with the dispersion medium. When the dispersion medium is a solid material, the guest compound will exist in the dispersion medium uniformly and therefore deterioration of physical properties caused by mixing of a dispersoid will be reduced very much.

A guest compound preferable for use in this disclosure is not specifically limited as long as it is heretofore difficult to be incorporated into abrasive material products and is an additive or the like which is required to have a sustained release property. Such an additive is generally a liquid, and particularly is a liquid which has a low miscibility with a binding resin. In a certain embodiment, it is a lubricant, an aromatic, a deodorant, or the like.

The lubricant is not specifically limited as long as it has been heretofore employed as means for preventing heat generation in conducting abrasion. Examples thereof include fatty acids which are solid at room temperature such as stearic acid and myristic acid, fats which are liquid at room temperature such as squalene, synthetic resin-based lubricants such as silicon oils, olefin-polymerized oils, diester oils, polyoxy alkylene glycols and halogenated hydrocarbon oils, and petroleum lubricants such as paraffin wax. The lubricants which are liquid at room temperature contribute to an instantaneously effecting property and the lubricants which are solid at room temperature contribute to the durability of a lubricating effect. Therefore, use of a liquid lubricant and a solid lubricant in combination is available and this will attain a good lubricating effect for a long period of time.

The aromatic is not specifically limited as long as it has been heretofore employed for generating a good fragrance at the time of abrasion work. Examples thereof include a menthol reagent and a vanillin reagent.

The deodorant is not specifically limited as long as it has been heretofore employed for reducing an offensive smell emitted at the time of abrasion work and removing such a smell. For example, various types of reagents which can chemically react with an offensive smell-causing component to change it into an odorless component, and silver or silver containing compounds, polymer gels, and the like which are capable of suppressing malodorous components. In such a case, inclusion of a host compound in a vacant state can result in exhibition of deodorant effect even if no guest compound is contained.

Host compounds preferable for use in this disclosure are cyclodextrins. Cyclodextrins are cyclic oligosaccharide having 6 to 8 glucose units linked together. The 6-unit body, the 7-unit body, and the 8-unit body are called α-cyclodextrin, β-cyclodextrin, and γ-cyclodextrin, respectively. A cyclodextrin molecule can contain a guest compound molecule within the space inside its cyclic skeleton. Regarding such cyclodextrins, one having an appropriate ring size can be chosen depending upon the size of the guest compound molecule. A cyclodextrin is hydrophobic within its vacancy and therefore it tends to contain a hydrophobic molecule like lubricants.

A cyclodextrin has hydroxyl groups outside the ring, and therefore it is generally hydrophilic. However, it can be lipophilized by introduction of a functional group. Specific examples of a lipophilic cyclodextrin include methylcycloheptaamylose. In a certain embodiment, a hydrophilic dextrin is used after addition to an aqueous dispersion medium and a lipophilic dextrin is used after addition to a solvent-based dispersion medium. This is because the dispersibility of an inclusion compound is improved.

Inclusion compounds are prepared by methods known to persons skilled in the art. For example, a host compound is dissolved in a solvent to form a solution and a guest compound is added slowly to this solution to homogenize it. If needed, the solvent is then removed. At the time of forming an inclusion compound, a host compound and a guest compound are caused to react at a ratio such that no unincluded free guest compound will remain. This is because by doing so, no free guest compound remains after the reaction of forming an inclusion compound and therefore a solid material to which the resulting inclusion compound is added will not be plasticated to become poor in strength.

When the number ratio of the host compound molecules to the guest compound molecules constituting an inclusion compound is 1/1, the molar ratio of the guest compound molecules to the host compound molecules to be used in forming the inclusion compound is from 0.1 to 3.0, in a certain embodiment it is from 0.8 to 1.2, and in a certain embodiment it is from 1.8 to 2.2.

The abrasive material product to be used in this disclosure may be any one which contains a binder containing a resin. Specific examples of such an abrasive material product include non-woven fabric abrasive material products, sponge abrasive material products, coated abrasive material products, grinding wheels, and grinding wheels comprising abrasive particles bound with urethane foam. Such abrasive material products may or may not contain abrasive particles.

In a certain embodiment, an inclusion compound is caused to be contained in a binder and then is used for abrasive material products. The content of the inclusion compound relative to 100 parts by mass of the resin component in the binder is 0.5 to 200 parts by mass, in a certain embodiment it is 1.5 to 60 parts by mass, and in a certain embodiment it is 10 to 30 parts by mass. It is because if the content of the inclusion compound is within the range of 0.5 parts by mass to 200 parts by mass, an effect derived from the guest compound, for example a sufficient effect of controlling heat generation, and the strength of the binder can be maintained.

While the form of the abrasive material product of this disclosure is not specifically limited as mentioned above, the abrasive material product of this disclosure is, in a certain embodiment, a non-woven fabric abrasive material product in which a non-woven fabric is used as a substrate. The non-woven fabric is a bulky sheet-shaped material made of fibers arranged at random. The non-woven fabric is only required to be a material well known to those skilled in the art as a substrate for a non-woven fabric abrasive material product.

Preferable non-woven fabrics include: those made from thermoplastic organic fibers such as fibers made of polyamides (for example, Nylon 6 and Nylon 6,6 made from polycaprolactam and polyhexamethyladipamide); polyolefins (for example, polyethylene and polypropylene); polyesters (for example, polyethylene terephthalate); polycarbonates; and the like. Non-woven fabrics generally employed have been made from Nylon fibers and polyester fibers. Thickness values of fibers thereof are generally on the order in the range of from 19 to 250 μm in diameter. A thickness of a non-woven fabric is generally on the order in the range of from 2 to 50 mm.

The binder is a material which binds constitutional elements of an abrasive material product together. The binder may be any material which is of enough strength for maintaining the unity of the constitutional elements of the abrasive material product during an abrading operation. Generally, a binder contains a resin component and, if needed, an additive as components.

Examples of materials which can be used as the resin component include phenol resin, urea-formaldehyde resin, shellac, epoxy resin, isocyanurate, polyurethane, and hide glue.

A resin component which is preferable to be used for a non-woven fabric abrasive material product, which is one of the abrasive material products of this disclosure, is an organic resin whose rigidity is relatively high. For example, a resin is preferable which exhibits a tensile strength after curing of 3000 psi or more, from 3000 to 11000 psi in one embodiment; an elongation of 180% or more, from 180 to 800% in a certain embodiment; a Shore D hardness of 40 or more, from 40 to 80 in a certain embodiment; and a 100% modulus of 1 MPa or more, from 10 to 50 MPa in a certain embodiment.

If the tensile strength of a resin component is 3000 psi or more, the binder has enough strength and rigidity after curing and is suitable for a non-woven fabric abrasive material product. If the elongation is 180% or more, the binder has enough softness after curing and is suitable for a non-woven fabric abrasive material product. If the shore D hardness is 40 or more, abrasive particles are resistant to falling off from an abrasive material during abrasion process. If the 100% modulus is 1 MPa or more, the binder has strength and rigidity high enough after curing and is suitable for an abrasive material.

A specific example of such a resin is polyurethane resin. Polyurethane resin can be obtained by reacting a polyisocyanate and a curing agent each other. It is permissible to use a polyisocyanate whose isocyanate groups have been blocked.

When the polyurethane resin is solvent-based, examples of commercial available polyisocyanates include, as solvent-based products, ADIPRENE (registered trademark) L-type resins manufactured by Uniroyal Chemical Co. (e.g., L-42, L-83, L-100, L-167, L-200, L-213, L-300, L-315).

While a polyalcohol or a polyamine may be used as a curing agent to be used for a solvent-based polyisocyanate, preferable examples include 4,4'-methylene bis-2-chloroaniline (MOCA) and p,p'-methylenedianiline, which is phenol having been treated at its terminals with 4,4'-methylenebisaniline.

Examples of commercially available water-based polyurethane resin include ADEKA BONTIGHTER (registered trademark) type resins available from Asahi Denka Co., Ltd. (e.g., HUX-232, HUX-240, HUX-260, HUX-320, HUX-350, HUX-380, HUX-381, HUX-380A, HUX-386, HUX-401, HUX-670, HUX-290H, HUX-290N, HUX-394 and HUX-680).

Examples of the curing agent to be used for a water-based polyurethane resin include melamine type resins (e.g., "MELAN 5100" manufactured by Hitachi Chemical Co., Ltd.).

Water-based resin components may be used. A water-based resin generally takes a state where resin particles are dispersed uniformly in water, which is referred to as an emulsion or a suspension. An uncured resin component has to be water-dispersible and it is preferably thermocurable. This is because that it is easy to obtain a non-woven fabric abrasive material product by shaping. It is preferable that a resin component have a curing temperature in the range of from 100 to 300° C. and especially in the range of from 100 to 200° C. The reason is that if the curing temperature of the resin component is within the range of 100 to 300° C., sufficient curing occurs, so that no abrasive particles will fall off and abrasive power can be maintained; and falling off of abrasive particles caused by decomposition of a resin component will not occur, so that abrasive power can be maintained.

An uncured resin component shows preferably no tackiness even if being touched with a finger or the like in an environment at room temperature. This is because it becomes easy to handle an abrasive material intermediate obtained by coating a binder precursor on a non-woven fabric and then drying it.

A preferable resin component is a thermocurable resin which contains an isocyanate-terminated polymer having an anionic group, a thermocurable acrylic polymer having a hydroxyl group and a melamine-based crosslinking agent and shows water-dispersibility. Combination of an isocyanate polymer and an acrylic polymer, which is a hard segment, can adjust characteristics of a resin component optimally for adhering abrasive particles to a non-woven fabric.

As a result, the water-based binder employed in this disclosure has a strength for holding abrasive particles equal to or higher than that attained by a solvent-based binder, thereby preventing abrasive particles from falling off from a non-woven fabric and enabling the non-woven fabric to be provided with a proper self-renewal function so that abrading with a fresh abrading surface can be effected at all times.

An isocyanate-terminated polymer having an anionic group, a thermocurable acrylic polymer having a hydroxyl group and a melamine-based crosslinking agent may be mixed respectively in a form of an emulsion or an aqueous dispersion.

The isocyanate-terminated polymer having an anionic group is an isocyanate-terminated polymer having an anionic group in a molecule thereof alone or its mixture with an isocyanate-terminated polymer having no anionic group. In a certain embodiment, it is preferable to use one having an anionic group within the range of from 0.001 to 0.5 equivalent weight per 100 g of a resin component (the total of an isocyanate-terminated polymer having an anionic group in a molecule thereof and an isocyanate-terminated having no anionic group in a molecule thereof) because the resin component has so good water-dispersibility that an aqueous dispersion can be obtained without using an emulsifier or a dispersing agent. Examples of the anionic group include a carboxyl group, a sulfone group and a combination thereof. In a certain embodiment, it is a carboxyl group.

The isocyanate-terminated polymer having an anionic group in a molecule thereof can be obtained by means of a conventionally known method. Taking a case of introduction of carboxyl group as an example, the polymer can be obtained through a reaction of a polyisocyanate with a polyether polyol and/or a polyester polyol, as a polyol component, having a diol unit including a carboxyl group such as 2,2-dimethylolpropionic acid, 2,2-dimethylolbutric acid, 2,2-dimethylolvaleric acid or the like.

A polyol component of polyether polyol and/or polyester polyol used in obtaining an isocyanate-terminated polymer having an anionic group in a molecule thereof and an isocyanate-terminated polymer having no anionic group in a molecule thereof is desirably of an average molecular weight in the range of from 500 to 4000, wherein the polyisocyanate component is not specifically limited and examples thereof include aliphatic polyisocyanates such as tetramethylene diisocyanate, hexamethylene diisocyanate, lysine diisocyanate and the like; alicyclic polycyanates such as 1,4-cyclohexylene diisocyanate, isophorone diisocyanate, 4,4'-dicyclohexyl diisocyanate and the like; and aromatic polyisocyanates such as tolylene diisocyanate, 4,4'-diphenylmethane diisocyanate and the like, among which an aliphatic or alicyclic polyisocyanate is preferable.

An isocyanate-terminated polymer described above may also be an isocyanate-terminated polymer chain-extended with dialkyl amine, dialkyl hydrazide or the like, any of which can be optionally selected according to an application in the range as far as a water-dispersion can be achieved. Water-dispersions of a polymer having an anionic group in a molecule thereof are sold on the market, examples of which include the polymers of "BONTIGHTER" type, manufactured by Asahi Denka Co., Ltd. as described above.

A thermocurable acrylic polymer having a hydroxyl group is preferably an acrylic polymer emulsion obtained by uniformly dispersing in water. The acrylic polymer has a hydroxyl value in the range of from 40 to 100. If the hydroxyl group is less than 40, the number of reaction sites is small to thereby cause a reaction insufficiently, disabling the object of the present disclosure to be achieved. On the other hand, if the hydroxyl value exceeds 100, water-proofness of a binder after curing is reduced. The acrylic polymer has an acid value in the range of from 1 to 30. If the acid value is less than 1, a stable emulsion is hard to be obtained, while if exceeding 30, a hydrophilicity of a polymer is enhanced; therefore, an emulsion becomes of a high viscosity and a water-proofness of an adhesive agent is reduced. The acrylic polymer has a glass transition temperature in the range of from −40 to 10° C. If the glass transition temperature is lower than −40° C., a binder has faults in physical strength and durability, while if higher than 10° C., a hardness of a binder increases and a flexibility thereof in low temperature is reduced.

An acrylic polymer emulsion is prepared from unsaturated monomers as described below:

1. Examples of acrylic-based monomers each having a hydroxyl group include ethylenic unsaturated monomers each having a hydroxyl group such as 2-hydroxyethyl acrylate, 2-hydroxyethyl methacrylate, 2-hydroxypropyl methacrylate, 2-hydroxypropyl acrylate, lactone-modified 2-hydroxyethyl acrylate, and lactone-modified 2-hydroxyethyl methacrylate.

2. Examples of alkyl esters of acrylic acid or methacrylic acid include methyl acrylate, ethyl acrylate, propyl acrylate, isopropyl acrylate, butyl acrylate, hexyl acrylate, octyl acrylate, lauryl acrylate, cyclohexyl acrylate, methyl methacrylate, ethyl methacrylate, propyl methacrylate, isopropyl methacrylate, butyl methacrylate, hexyl methacrylate, octyl methacrylate, lauryl methacrylate and the like.

3. Examples of α,β-ethylenic unsaturated carboxyl acids include acrylic acid, methacrylic acid, crotonic acid, itaconic acid, maleic acid, maleic anhydride, fumaric acid and the like.

4. Examples of vinyl aromatic compounds include styrene, α-methylstyrene, vinyltoluene, p-chlorostyrene, vinylpyridine and the like.

5. Examples of other vinyl compounds include ethylene glycol diacrylate, ethylene glycol dimethacrylate, triethylene glycol diacrylate, tetraethylene glycol dimethacrylate, 1,6-hexanediol diacrylate, divinylbenzene, trimethylolpropane triacrylate and the like.

The unsaturated monomers can be used in mixtures of an acrylic monomer including a hydroxyl group and an α,β-ethylenic unsaturated carboxyl acid monomer as indispensable components; and if necessary, an alkyl ester of acrylic acid or methacrylic acid and other vinyl compounds; and the like, wherein kinds and a mixing ratio of each can be properly selected according to a desired physical property of a resin.

Preferable examples of chain transfer agents for adjusting a molecular weight include methyl mercaptan, ethyl mercaptan, isopropyl mercaptan, butyl mercaptan, pentyl mercaptan, hexyl mercaptan, octyl mercaptan, decyl mercaptan, undecyl mercaptan, dodecyl mercaptan, t-dodecyl mercaptan and the like.

Production of a copolymer contained in the acrylic polymer emulsion of this disclosure is performed according to a known method and can be realized with, for example, a solution polymerization method, an emulsion polymerization method or a suspension polymerization method, among which the emulsion polymerization method is preferable. A desired acrylic polymer emulsion can be obtained generally by causing monomers to react in the presence of a dispersion stabilizer such as a surfactant and in the presence of a polymerization initiator, e.g. a radical initiator for a radical polymerization such as ammonium persulfate, at a reaction temperature within the range of from 60 to 95° C. in a certain embodiment, for a time within the range of from 4 to 8 hours in a certain embodiment, followed by three-dimensional crosslinking and neutralization with an amine. Diameters of fine particles in the obtained acrylic polymer emulsion are preferably in the range of from 50 to 200 nm.

Such a microemulsion is on the market and examples thereof include "Hitaloid type" manufactured by Hitachi Chemical Co., Ltd., product No. AE8200 and like.

Melamine-based crosslinking agents have only to be known melamine-based crosslinking agents as a crosslinking agent for synthetic resin. The agents can be dispersed in water either with an emulsifying agent or a dispersing agent, if necessary, or without them. A melamine-based crosslinking agent is not specifically limited and exemplified are "Melan 5100" manufactured by Hitachi Chemical Co., Ltd. and the like.

The mixing proportions of the components of a binder are generally 100 parts by mass of an isocyanate-terminated polymer having an anionic group; 1 to 50 parts by mass of a thermocurable acrylic polymer having a hydroxyl group; and 0.01 to 20 parts by mass of a melamine-based crosslinking agent. If the amount of the thermocurable acrylic polymer having a hydroxyl group is within the above-mentioned range, the softness of the binder after curing will be maintained at a moderate level, and a non-woven fabric abrasive material product with excellent performance can be obtained.

The abrasive material product of this disclosure may contain a reactive inorganic endothermic compound. The reactive inorganic endothermic compound is a solid inorganic substance which is allowed to react with heat generated in conducting abrasive work, and to transform into metal oxide, with absorbing heat during reaction. The reactive inorganic endothermic compound has preferably a reaction temperature of not more than 300° C. When the abrasive material product is a non-woven fabric abrasive material product, nylon 6,6 and polyesters are useful for fibers of the non-woven fabric. The reason is that the heat resisting temperature of polyester fibers is about 300° C. In a certain embodiment, the reaction temperature of the reactive inorganic endothermic compound is from 100 to 250° C., and in another certain embodiment, it is from 150 to 230° C.

Specific examples of the reactive inorganic endothermic compound include aluminum hydroxide, calcium hydroxide, calcium aluminate, magnesium hydroxide, fibrous magnesium hydroxide, basic magnesium carbonate, zinc borate, ammonium polyphosphate, dawsonite, hydrotalcites and the like. Examples of preferable reactive inorganic endothermic compounds include aluminum hydroxide, calcium aluminate and basic magnesium carbonate. Particularly preferred are hydrotalcites.

The reactive inorganic endothermic compound is contained, for example, in an amount of from 10 to 300 parts by mass, and from 10 to 200 arts by mass in a certain embodiment, and from 30 to 100 parts by mass in another certain embodiment relative to 100 parts by mass of the resin components of a binder. If the used amount of the reactive inorganic endothermic compound is within the aforementioned ranges, an abrasive material product can be obtained which is sufficient in endothermic function and binder strength.

The abrasive material product of this disclosure may contain abrasive particle depending on the application. Abrasive particles are those commonly used in the technical field. Particles which may be used are typically particles having an average diameter of from 1 to 2000 μm, from 10 to 500 μm in a certain embodiment, and from 10 to 100 μm in a certain embodiment, and having a Mohs hardness of from 4 to 10 Mohs, and from 6 to 9 Mohs in a certain embodiment. Specific examples that can be used are: particles of pumice, topaz, garnet, alumina, corundum, silicon carbide, zirconia, diamond and the like. The particles may be a mixture in diameter of different kinds or a mixture of different kinds.

For example, abrasive particles are contained in an amount of from 50 to 1000 parts by mass, and from 100 to 500 parts by mass relative to 100 parts by mass of the resin components of a binder.

The abrasive material product of this disclosure can be prepared by using an inclusion compound and a binder in accordance with a method known to those skilled in the art. For example, an inclusion compound and, if needed, other components such as a reactive inorganic endothermic compound are added to a liquid resin component and fully dispersed to prepare a coating liquid of a binder. The liquid resin component may be either a solution or an aqueous dispersion.

When the abrasive material product is a non-woven fabric abrasive material product, this coating liquid is applied to the surface of the fibers of the non-woven fabric. Abrasive particles are scattered on the applied binder and attached thereto. Then, an organic solvent, water, and the like are vaporized from the binder to dry. When a thermocurable resin is used as a resin component, the binder is heated for a certain time to cure it. Generally, the binder is held at 100 to 300° C. for 10 to 30 minutes to be cured. It is noted that when a reactive inorganic endothermic compound is used, the heating temperature has to be held at a temperature such that the reactive inorganic endothermic compound substantially fails to start reacting.

It is also permissible to add abrasive particles as well in preparing a coating liquid of a binder and then apply the binder and the abrasive particles simultaneously to a non-woven fabric. Furthermore, drying of the binder and curing of the thermocurable resin may be conducted either in the same heating step or in different heating steps. Even when the drying of the binder and the curing of the thermocurable resin are implemented in different steps, the thermocurable resin may be partly cured in the drying step.

Figure 1B:
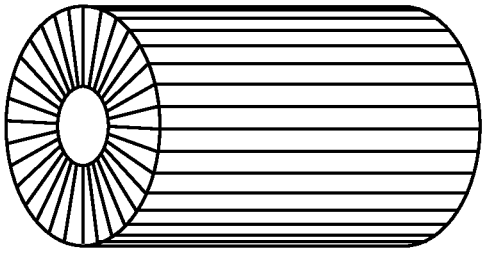
Figure 1C:
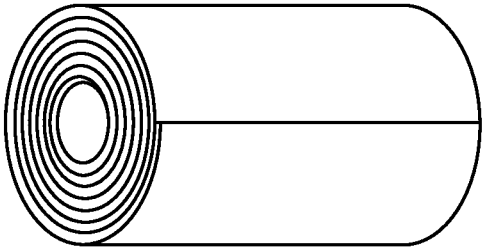

As described above, a non-woven fabric used as a substrate is a bulky fibrous material and excellent in elasticity; therefore, easy deformation and restoration can be secured. Therefore, a laminate including plural non-woven fabric layers is easy in deformation and can be shaped with a relative freedom under a pressure. In one embodiment of this disclosure, a three-dimensional non-woven fabric abrasive material product is manufactured with the help of an easy shapability of the non-woven fabric. A typical example of a three-dimensional non-woven fabric abrasive material product is a cylindrical abrasive brush having a center hole. FIG. 1 is a perspective view showing typical structure types of cylindrical abrasive brushes each having a center hole. (a) shows a view of a laminate type, (b) a flap type and (c) a spiral type.

Figure 2:
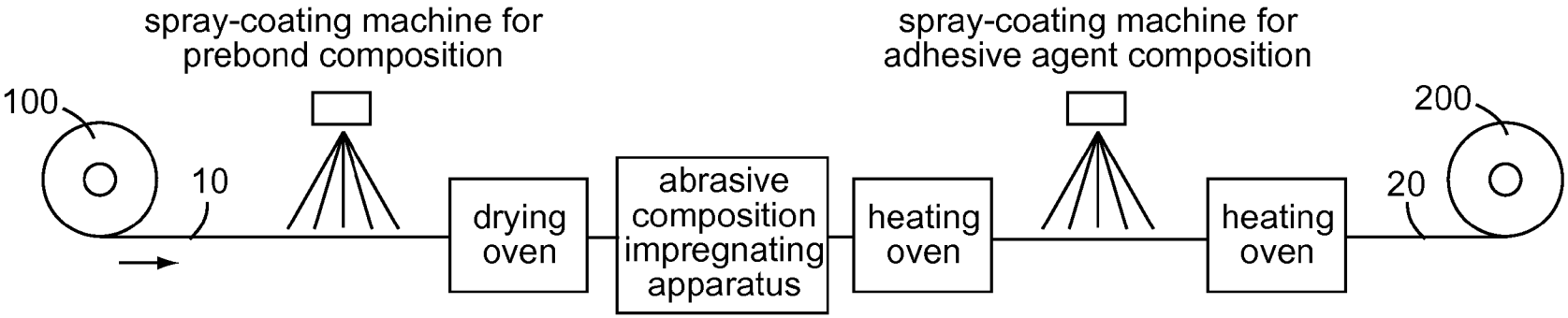
FIG. 2 Schematic diagram showing a process of obtaining an abrasive material intermediate used in manufacturing a three-dimensional non-woven fabric abrasive material product.

FIG. 2 is a schematic diagram showing a process of manufacturing an abrasive material intermediate used in manufacturing a three-dimensional non-woven fabric abrasive material product. First, a non-woven fabric 10 is paid out from a non-woven fabric roll 100. Then, the non-woven fabric 10 is impregnated with a mixture of a binder and abrasive particles. The impregnated non-woven fabric is heated to fix a thermocurable resin and the abrasive particles onto surfaces of the non-woven fabric fibers. A coating liquid of the binder is spray-coated thereon.

Then, an organic solvent, water and the like are evaporated from the binder to dry it in a drying furnace. The drying is conducted at a temperature for a time in a combination of which the thermocurable resin is not perfectly cured so that the binder is of non-tackiness at room temperature. This is because if the binder still sustains tackiness at room temperature after the drying step, it becomes difficult to handle and work the obtained abrasive material intermediate and because if the thermocurable resin is perfectly cured after the drying step, it becomes difficult to shape the abrasive material intermediate thereafter. In a certain embodiment, the drying step is conducted at a temperature in the range of from 100 to 120° C. for a time in the range of from 1 to 10 min. After the drying step, the obtained abrasive material intermediate 20 loses tackiness and thereby can be handled. Therefore, the abrasive material intermediate 20 can be rolled up and stored in the form of a roll 200.

Figure 3:
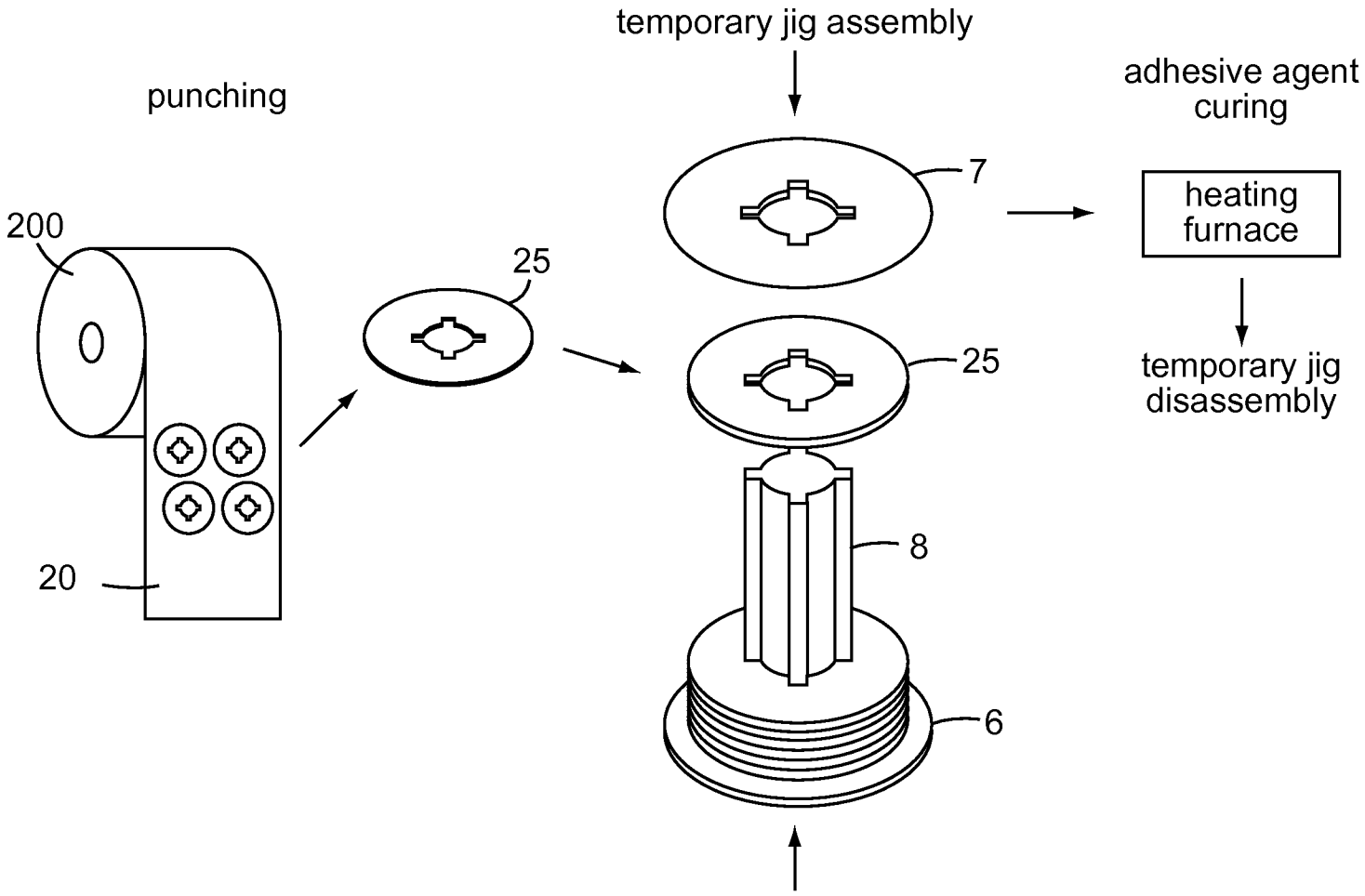
FIG. 3 Schematic diagram showing a process of manufacturing a three-dimensional non-woven fabric abrasive material product by using the abrasive material intermediate.

FIG. 3 is a schematic diagram showing a process of manufacturing a three-dimensional non-woven fabric abrasive material product by using an abrasive material intermediate. At first, the abrasive material intermediate 20 is paid out from the roll 200 of the abrasive material intermediate. Then, the abrasive material intermediate 20 is punched therethrough into proper shapes to obtain intermediate members 25. Jigs 6, 7 and 8 are used to superimpose plural intermediate members 25 one on another and the superimposed intermediate members 25 are compressed to a high density. Thereafter, the intermediate members 25 are heated in a compressed state to completely cure the binder precursor and to thereby fix a shape thereof. In a certain embodiment, the heat curing step is conducted at a temperature in the range of from 100 to 200° C. for a time in the range of from 10 to 60 min. In such way, a cylindrical abrasive brush having a center hole can be obtained (see FIG. 1(*a*)).

The non-woven fabric abrasive material product of this disclosure is suitable for applications in which fine finishing is required rather than abrasive power. An example of such applications is fine surface finishing such as mirror finishing. While the object which is to be subjected to mirror finishing is not specifically limited, preferred are metals which have tend to generate smears when using conventional abrasive material products and are of poor heat releasability, such as stainless steel, aluminum and titanium.

The non-woven fabric abrasive material product of this disclosure is also suitable for abrading a material which is poor in heat resistance. Examples of the material include resin, particularly thermoplastic resins and plastic materials.

A process for using the non-woven fabric abrasive material product of this disclosure is the same as that for the conventional non-woven fabric abrasive material product. That is, the non-woven fabric abrasive material product is kept in contact with a surface of a material to be abraded, and they are relatively moved under pressure. In a certain embodiment, friction or abrasion of the surface of an article to be abraded is conducted in dry mode. For example, the friction or abrasion can be conducted by pressing the major surface of a non-woven fabric abrasive material product against the surface of an article to be abraded and then rotating it. Abrasive conditions such as abrasive load, abrasive speed, and abrasive period may be appropriately determined.

While detailed description will be given of the present disclosure using examples, the present disclosure is not limited to the detailed description and unless otherwise described definitely in the examples, the term "part or parts" indicates those by mass.

EXAMPLES

Example 1

Fourteen grams of cyclodextrin ("CAVAMAX W6 Food" manufactured by Wacker Chemie) was dissolved in 100 g of distilled water. Six grams of squalene (manufactured by MARUHA) was added to this solution and was stirred to homogenize at room temperature. The resulting squalene-cyclodextrin complex solution (squalene concentration is 5% by mass) is called Premix A.

Fourteen grams of cyclodextrin ("CAVAMAX W6 Food" manufactured by Wacker Chemie) was dissolved in 100 g of distilled water. Four grams of stearic acid ("LUNAC S-98" manufactured by Kao Corp.) was added to this solution and the mixture was heated to 80° C. in order to change the stearic acid from solid to liquid to homogenize under stirring. The resulting stearic acid-cyclodextrin complex solution (stearic acid concentration is 3.4% by mass) is called Premix B.

A hydrotalcite ("DHT-6" manufactured by Kyowa Chemical Industry Co., Ltd.) was prepared as a reactive inorganic endothermic compound. An urethane resin emulsion manufactured by Asahi Denka Co., Ltd. "BONTIGHTER HUX-386" was prepared as a resin component. The properties (after curing) of this urethane resin are 5500 psi in tensile strength, 500% in elongation, 45 in Shore D hardness, and 8.4 MPa in 100% modulus. As abrasive particles, aluminum oxide having an average particle diameter of 14 μm ("WA800" manufactured by FUJIMI INCORPORATED) was prepared. As a non-woven fabric, a disk-shaped non-woven fabric pad ("Type-T" manufactured by 3M) made of 6 denier polyester, having a weight of 440 g/m$^2$, a thickness of 10 mm and a diameter of 10 cm was prepared.

A coating liquid was obtained by adding 240 parts of Premix A (solution), 228 parts of Premix B (solution), 100 parts of the reactive inorganic endothermic compound and 300 parts of the abrasive particles to 100 parts of the urethane resin, followed by kneading. This coating liquid was applied to both surfaces of a non-woven fabric by spray system. The dry-coating amount of the coating liquid was adjusted to 880 g/m$^2$. Thereafter, the material was put into an oven and heated at 110° C. for 20 min to cure the binder precursor. Thereby, a non-woven fabric abrasive disk was obtained.

The resulting non-woven fabric abrasive material was put with pressure on a plate-form work piece to be abraded at main surface and was rotated to conduct an abrasive test. A SUS plate (SUS304) was employed as the work piece to be abraded. The abrasive condition was adjusted to 2000 g/cm$^2$ in load, 6000 rpm and 12000 rpm in abrading speed, and 5 seconds in abrading time.

Observation of the abraded surface after the completion of the abrasion revealed that the surface had been finished as a mirror surface and there was no smear.

Examples 2, 3 and 4

An abrasive disk was prepared and an abrasive test was conducted in the same manner as Example 1 except for changing the composition of the coating liquid as shown in Table 1. The results were shown in Table 1.

Example 5

Fourteen grams of cyclodextrin ("CAVAMAX W6 Food" manufactured by Wacker Chemie) was dissolved in 100 g of distilled water. Four grams of stearic acid ("LUNAC S-98" manufactured by Kao Corp.) was added to this solution and the mixture was heated to 80° C. to homogenize under stirring. To this solution, 6 g of squalene (manufactured by MARUHA) was added and stirred at room temperature to homogenize. The resulting stearic acid-squalene-cyclodextrin complex solution (stearic acid/squalene concentration is 8.1% by mass) is called Premix C.

As a resin component, a phenol resin manufactured by Showa Highpolymer Co., Ltd. "Shonol BRS-300" was prepared. This phenol resin is a common thermocurable liquid resol type.

An abrasive disk was prepared and an abrasive test was conducted in the same manner as Example 1 except for changing the composition of the coating liquid as shown in Table 1. The results were shown in Table 1.

TABLE 1

| Example No. | | 1 | 2 | 3 | 4 | 5 | 6 | 7 | 8 |
|---|---|---|---|---|---|---|---|---|---|
| Urethane resin (water-based) *1 | | 100 | 100 | 100 | 100 | 100 | 100 | 100 | 100 |
| Phenol resin (solvent-based) *2 | | 0 | 0 | 0 | 100 | 0 | 0 | 0 | 100 |
| Hydrotalcite *3 | | 100 | 100 | 0 | 0 | 100 | 100 | 0 | 0 |
| Squalene *4 | | 12 | 12 | 12 | 12 | 0 | 0 | 0 | 0 |
| Stearic acid *5 | | 8 | 8 | 8 | 8 | 0 | 0 | 0 | 0 |
| Stearic acid/squalene *6 | | 0 | 0 | 0 | 0 | 20 | 20 | 20 | 20 |
| Cyclodextrin | | 56 | 56 | 56 | 56 | 28 | 28 | 28 | 28 |
| Aluminium oxide particles *7 | | 300 | 0 | 300 | 300 | 300 | 0 | 300 | 300 |
| Falling off of abrasive particles | | No | No | No | No | No | No | No | No |
| Smearing | 6000 rpm | No | No | No | No | No | No | No | No |
| | 12000 rpm | No | No | A little | A little | No | No | A little | A little |

*1 Urethane resin emulsion ("BONTIGHTER HUX-386" manufactured by Asahi Denka Co., Ltd.)
*2 Phenol resin ("Shonol BRS-300" manufactured by Showa Highpolymer Co., Ltd.)
*3 Hydrotalcite ("DHT-6" manufactured by Kyowa Chemical Industry Co., Ltd.)
*4 Premix A 240 parts (solution) was used.
*5 Premix B 228 parts (solution) was used.
*6 Premix C 248 parts (solution) was used.
*7 Aluminum oxide ("WA800" manufactured by FUJIMI INCORPORATED)

The results given in Table 1 show that heat generation is controlled and no smear is generated even when fine surface finishing was conducted in dry mode.

Comparative Examples 1 to 7

An abrasive disk was prepared and an abrasive test was conducted in the same manner as Example 1 except for changing the composition of the coating liquid as shown in Table 2. The results are shown in Table 2. However, in Comparative Examples 1, 2, 5, 6 and 7, no abrasive test could be conducted because of extremely low strengths of the abrasive disks.

TABLE 2

| Comparative Example No. | | 1 | 2 | 3 | 4 | 5 | 6 | 7 |
|---|---|---|---|---|---|---|---|---|
| Urethane resin (water-based) *1 | | 100 | 100 | 100 | 100 | 100 | 100 | 100 |
| Hydrotalcite *2 | | 100 | 100 | 100 | 100 | 0 | 100 | 300 |
| Squalene *3 | | 12 | 12 | 0 | 0 | 12 | 0 | 0 |
| Stearic acid *4 | | 8 | 8 | 0 | 0 | 8 | 0 | 0 |
| Cyclodextrin *5 | | 0 | 0 | 0 | 0 | 0 | 56 | 0 |
| Aluminium oxide particles *6 | | 300 | 0 | 300 | 0 | 300 | 300 | 300 |
| Falling off of abrasive particles | | Yes | Yes | No | No | Yes | Yes | Yes |
| Smearing | 6000 rpm | | | No | No | | | |
| | 12000 rpm | | | Yes | Yes | | | |

*1 Urethane resin emulsion ("BONTIGHTER HUX-386" manufactured by Asahi Denka Co., Ltd.)
*2 Hydrotalcite ("DHT-6" manufactured by Kyowa Chemical Industry Co., Ltd.)
*3 Manufactured by MARUHA Corporation.
*4 "LUNAC S-98" manufactured by Kao Corp.
*5 "CAVAMAX W6 Food" manufactured by Wacker Chemie
*6 Aluminium oxide ("WA800" manufactured by FUJIMI INCORPORATED)

REFERENCE NUMERALS

10: non-woven fabric
100: non-woven fabric roll
20: abrasive material intermediate
200: abrasive material intermediate roll
25: intermediate member
6, 7 and 8: jigs

What is claimed is:

1. An abrasive material product comprising a binder and an inclusion compound composed of a host compound and a lubricant contained therein as a guest compound.

2. The abrasive material product according to claim 1, further comprising an inclusion compound composed of a host compound and an aromatic or a deodorant contained therein as a guest compound.

3. The abrasive material product of claim 1, wherein the host compound is cyclodextrin.

4. The abrasive material product according to claim 1, wherein the binder comprises a resin component and content of the inclusion compound relative to 100 parts by mass of the resin component is from 0.5 to 200 parts by mass.

5. The abrasive material product according to claim 1, wherein molar ratio of molecules of the guest compound to molecules of the host compound is from 0.1 to 3.0.

6. The abrasive material product according to claim 1, wherein the binder comprises a water-based resin.

7. The abrasive material product according to claim 1, wherein the binder comprises a solvent-based resin.

8. The abrasive material product according to claim 1, wherein the abrasive material product is a non-woven fabric abrasive material product having a non-woven fabric and a binder adhered to fibers of the non-woven fabric.

9. The abrasive material product according to claim 1, further comprising a reactive inorganic endothermic compound.

10. The abrasive material product according to claim 1, further comprising abrasive particles.

11. A method for producing an abrasive material product of claim 1 comprising:

a step of adding and uniformly dispersing an inclusion compound composed of a host compound and a lubricant contained therein as a guest compound to a binder to obtain a liquid to be applied, a step of applying the resulting liquid to be applied to a non-woven fabric, and a step of curing the binder.

12. The abrasive material product of claim 1, wherein the inclusion compound is formed by reacting the host compound and the guest compound at a ratio such that no unincluded free guest compound remains.

13. The abrasive material product of claim 1, wherein the inclusion compound is uniformly dispersed in the binder.

14. The abrasive material product of claim 12, wherein the inclusion compound is uniformly dispersed in the binder.

* * * * *